US010301797B2

(12) United States Patent
Iwamoto et al.

(10) Patent No.: US 10,301,797 B2
(45) Date of Patent: May 28, 2019

(54) COUNTERWEIGHT SUPPORTING STRUCTURE FOR CONSTRUCTION MACHINE

(71) Applicant: Caterpillar SARL, Geneva (CH)

(72) Inventors: Takahiro Iwamoto, Tokyo (JP); Kentaro Nakayama, Tokyo (JP); Takeshi Tsuneyoshi, Tokyo (JP)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 15/737,269

(22) PCT Filed: Jun. 14, 2016

(86) PCT No.: PCT/EP2016/063658
§ 371 (c)(1),
(2) Date: Dec. 15, 2017

(87) PCT Pub. No.: WO2016/202811
PCT Pub. Date: Dec. 22, 2016

(65) Prior Publication Data

US 2018/0171589 A1 Jun. 21, 2018

(30) Foreign Application Priority Data

Jun. 18, 2015 (JP) ..... 2015-122739

(51) Int. Cl.

| | |
|---|---|
| ***E02F 9/18*** | (2006.01) |
| ***E02F 3/30*** | (2006.01) |
| ***E02F 9/08*** | (2006.01) |
| *E02F 3/36* | (2006.01) |

(52) U.S. Cl.
CPC ..... *E02F 9/18* (2013.01); *E02F 3/304* (2013.01); *E02F 9/08* (2013.01); *E02F 3/36* (2013.01)

(58) Field of Classification Search
CPC ..... E02F 3/304; E02F 3/36; E02F 9/08; E02F 9/18
USPC ..... 414/719
See application file for complete search history.

(56) References Cited

U.S. PATENT DOCUMENTS 3,795,330 A * 3/1974 Jorgensen ..... E02F 9/18 414/719
5,833,268 A * 11/1998 Aldrovandi ..... B60R 9/00 280/759
5,906,155 A * 5/1999 Hammond ..... B30B 15/04 100/231

(Continued)

FOREIGN PATENT DOCUMENTS

JP H09-209407 A 8/1997
JP 2001-032328 A 2/2001
KR 2010-0020567 A 2/2010

(Continued)

*Primary Examiner* — Ronald P Jarrett

(57) ABSTRACT

To improve the precision of position of a fastener hole and a seating face for mounting a counterweight, a counterweight supporting member is comprised of a support plate erected and fixed at the rear end of a revolving frame and a supporting member attached to the support plate. The supporting member is comprised of a base member that is locked and secured to a through hole opened on the support plate in a back and forth adjustable manner and has a counterweight fixing surface and a bolt fastening member in which a fastener hole for receiving a fastener bolt is formed.

20 Claims, 9 Drawing Sheets

(56) References Cited

U.S. PATENT DOCUMENTS

2006/0202500 A1* 9/2006 Eschebach ..... B62D 33/0273
296/57.1

FOREIGN PATENT DOCUMENTS

KR 2010-0091443 A 8/2010
KR 2011-0045364 A 5/2011

* cited by examiner (A)

(B)

(A)

(B)

(A)

(B)

COUNTERWEIGHT SUPPORTING STRUCTURE FOR CONSTRUCTION MACHINE

CROSS-REFERENCE TO RELATED APPLICATIONS

This application is a national phase application of International Patent Application No. PCT/EP2016/063658 filed Jun. 14, 2016, which claims priority to Japanese Patent Application No. 2015-122739 filed Jun. 18, 2015, both of which are incorporated by reference herein in their entireties for all purposes.

TECHNICAL FIELD

The present invention relates to the technical field of a counterweight supporting structure for a construction machine such as a hydraulic shovel.

BACKGROUND ART

Some construction machines have a counterweight for ensuring the balance of the machine body. These construction machines are generally known to have a configuration in which the counterweight, when mounted on the machine body, is supported by a counterweight support through fastening bolts, the counterweight support being provided in the rear portion of the vehicle body frame. For instance, in a hydraulic shovel, an example of a construction machine, the counterweight support is provided in the rear portion of the vehicle body frame (slewing frame) configuring the base of an upper slewing body, wherein the counterweight is supported by the counterweight support through fastening bolts fastened thereto. In such a construction machine, the counterweight support has a counterweight mounting seat surface that is integrally fixed by adhesion or the like to the rear portion of the vehicle body frame to configure a part of the vehicle body frame and comes into surface-contact with the counterweight, wherein the counterweight mounting seat surface is sometimes machined to ensure a flat surface or to form fastener holes (screw holes) for the fastening bolts by using machine tools.

Incidentally, many of the construction machines are large vehicles, and the larger the vehicle sizes, the more difficult it is to machine the counterweight mounting seat surface after the completion of the assembly of the vehicle body frame, because of the size of the machine tools. Therefore, a counterweight support in which the counterweight mounting seat surface has already been machined beforehand is welded to form the vehicle body frame. In this case, however, the counterweight support might become shifted from a predetermined regular position thereof due to welding stress or the like that occurs upon the assembly of the vehicle body frame, resulting in shifting of the counterweight mounting seat surface and fastener holes from their regular positions. Especially when the reference for positioning is set at the front side of the vehicle body frame or a slewing bearing portion, the counterweight support located on the rear end side of the vehicle body frame is displaced significantly due to the accumulation of welding stress. This makes it difficult to attach the counterweight and generates a gap or level difference between the counterweight and a vehicle body cover or a skirt channel disposed in front of the counterweight, because the counterweight is attached with the counterweight support being displaced, resulting in damaging the appearance.

There have conventionally been known a technique for configuring the counterweight support by using a vertical plate extending from the vehicle body frame, a back plate and a bottom plate adhered respectively to upper and lower end surfaces of the vertical plate, and a pipe member that is capable of sliding vertically between the back plate and the bottom plate and has a counterweight mounting seat surface (counterweight supporting surface) on its upper surface, wherein the pipe member is adhered to a back plate and the bottom plate after the back plate and the bottom plate are adhered to the vertical plate, and a technique for adhering the back plate to the vertical plate extending from the vehicle body frame and thereafter adhering a block having a counterweight mounting seat surface on its upper surface to a cutout portion of the back plate.

Furthermore, there has also been known a technique for forming a boss fitting hole in the rear portion of the vehicle body frame, forming a boss capable of coming into engagement with the boss fitting hole in a front surface of the counterweight, and attaching the counterweight to the vehicle body frame by fastening a bolt passing through the boss, wherein the boss fitting hole is shaped into an oval having the horizontal length greater than the vertical length, and the boss fitting position in the boss fitting hole can be displaced/adjusted by a small amount in the lateral direction.

Summary

The invention described is a counterweight supporting structure for a construction machine having a counterweight, wherein, in order to support the counterweight on a counterweight support provided in a rear portion of a vehicle body frame by using a fastening bolt, the counterweight support is configured using a support plate that is fixed upright to the rear portion of the vehicle body frame, and a support member that is attached to the support plate fixed to the vehicle body frame, brought into abutment with the counterweight, and has the fastening bolt fastened thereto, the support member being configured with a base member that is fixed to the support plate in such a manner that a longitudinal position of the base member is adjustable, a bolt fastening member which is fixed to the base member in such a manner that vertical and lateral positions of the bolt fastening member are adjustable and which has a fastener hole to which the fastening bolt is fastened, and a counterweight mounting seat surface that is formed in the base member or the bolt fastening member and comes into abutment with the counterweight.

According to the invention described, the positional accuracy of the counterweight mounting seat surface and of the fastener hole can reliably be improved by adjusting the longitudinal position of the base member and the vertical and lateral positions of the bolt fastening member in order to attach the support member to the support plate.

Even when the fastener hole is displaced as a result of adjusting the bolt fastening member in the vertical and lateral directions, the bolt hole can be punched and fastened to the fastener hole without having the fastening bolt interfere with the base member.

Not only is it possible to ensure the perpendicularity of the base member with respect to the horizontal reference of the machine body, but also the flatness of the mounting seat surface can be ensured without performing any machining, but by adjusting the inclination of the base member with respect to the support plate.

DESCRIPTION OF EMBODIMENTS

Figure 1:
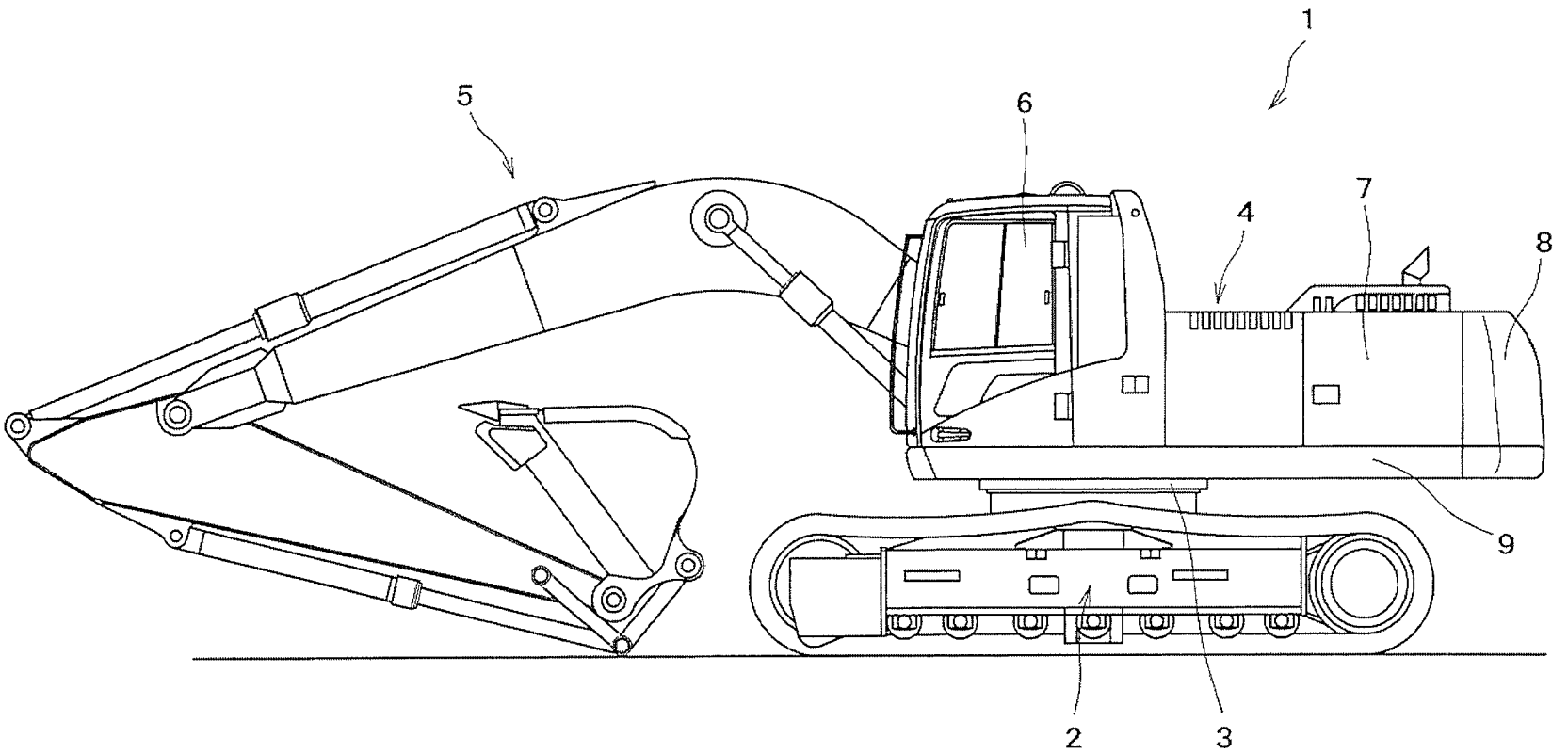
FIG. 1 is a side view of a hydraulic shovel.
Figure 2:
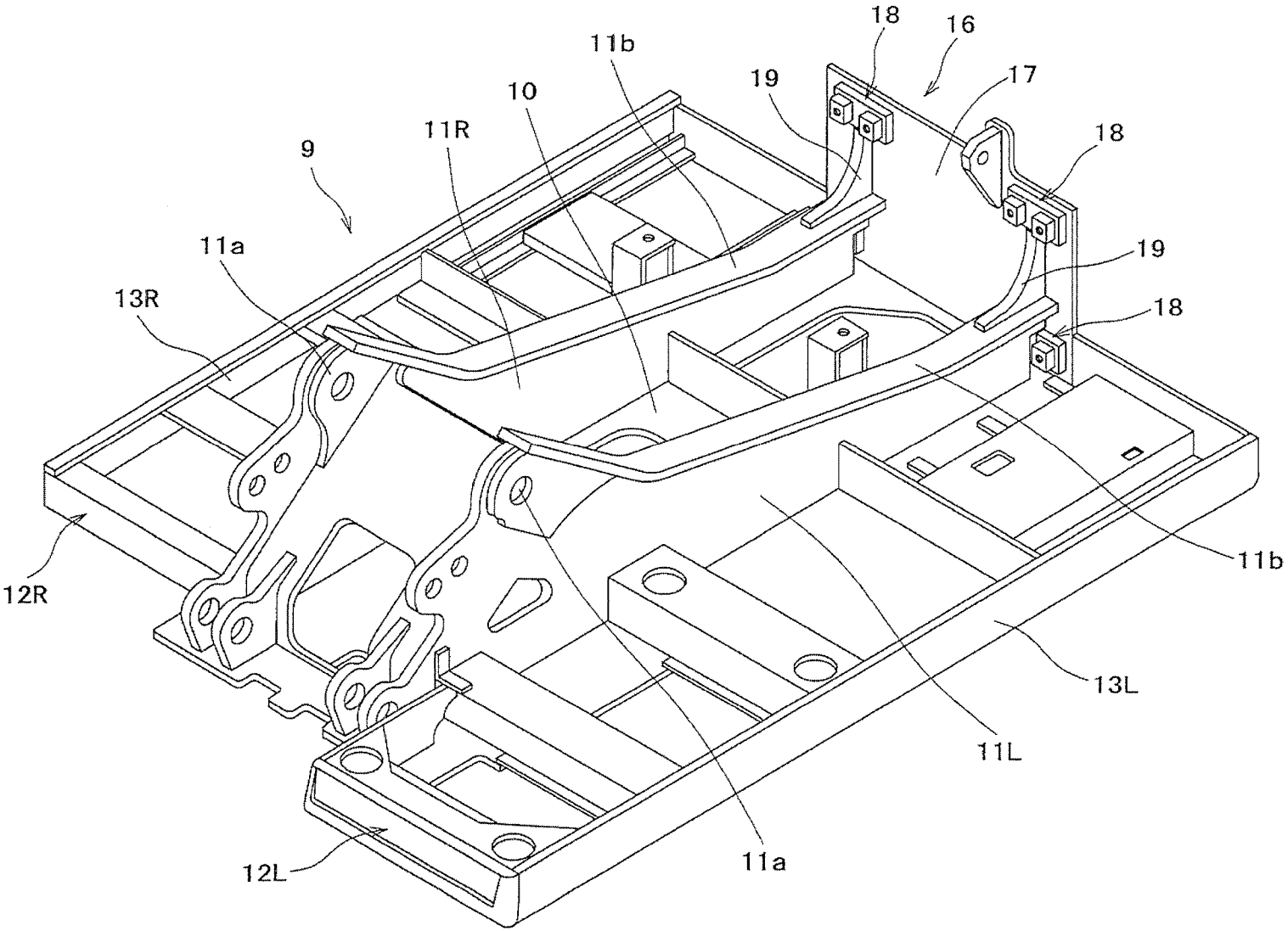
FIG. 2 is a perspective view of a slewing frame.
Figure 3:
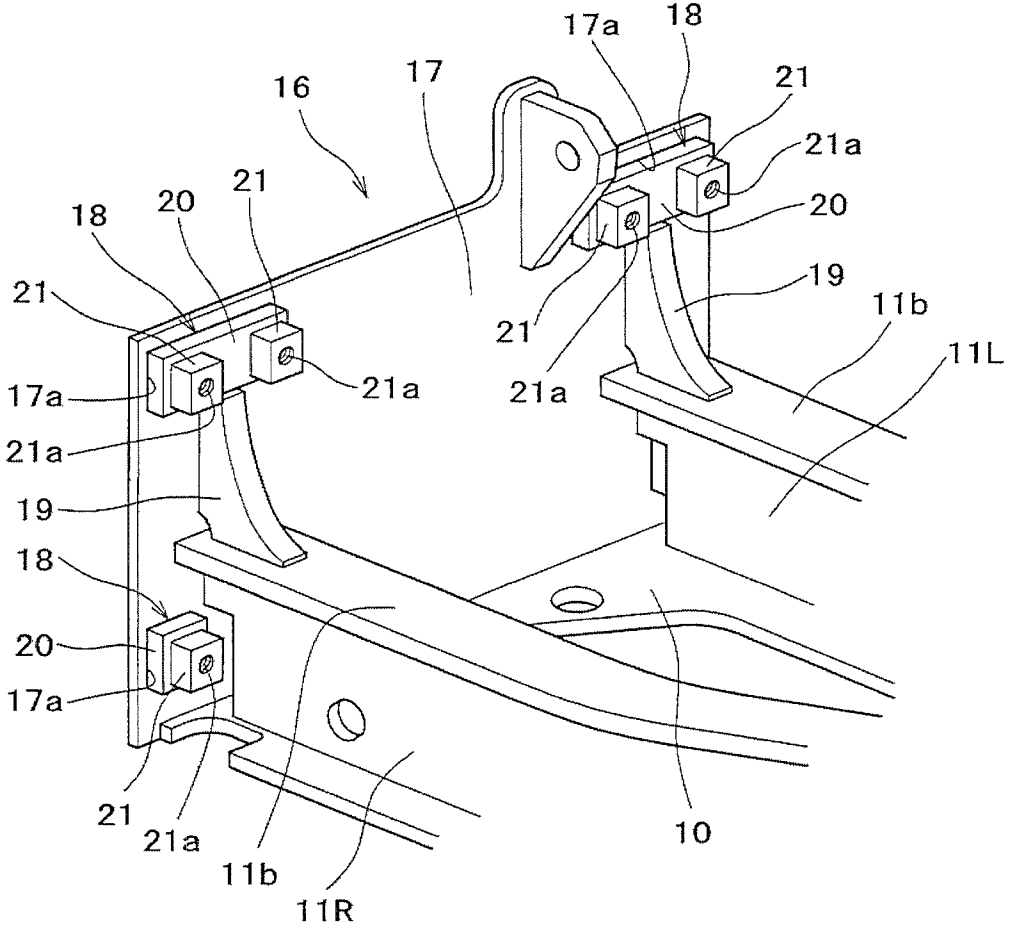
FIG. 3 is a perspective view of a counterweight support, viewed from the front.
Figure 4:
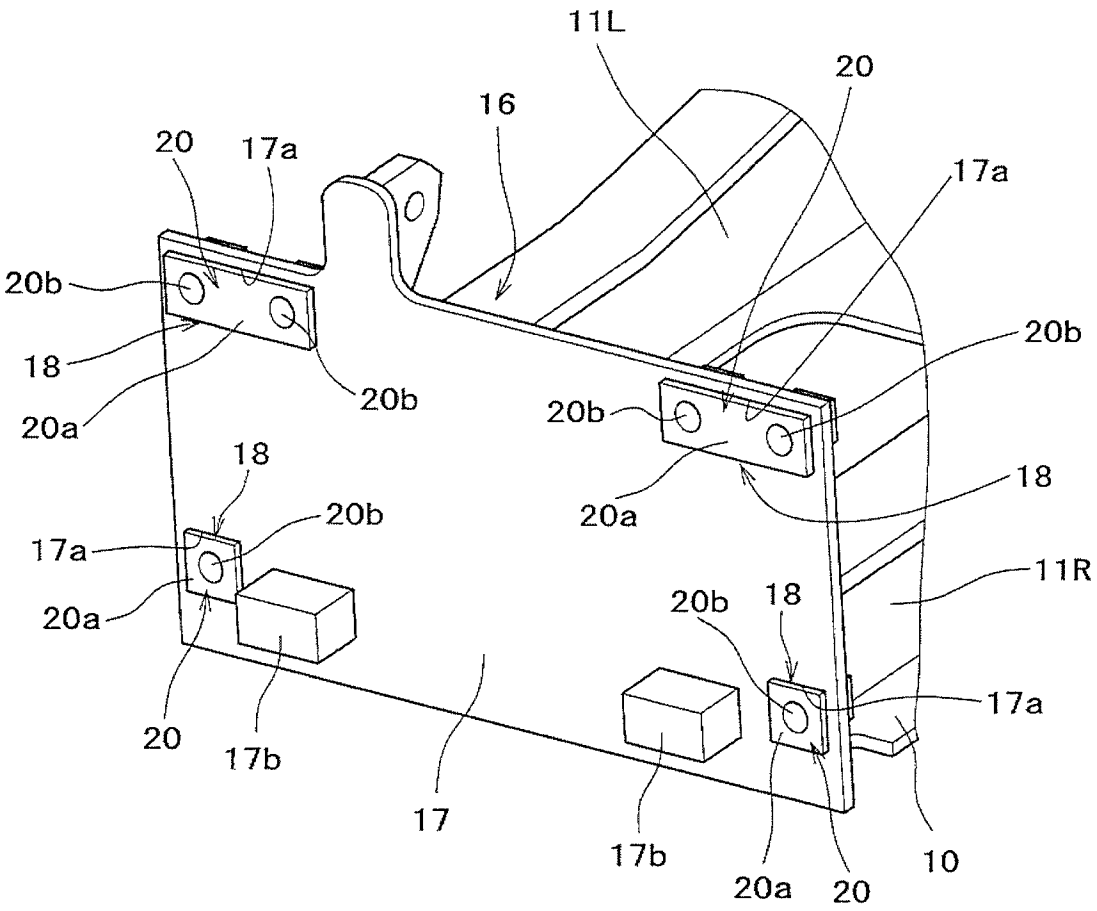
FIG. 4 is a perspective view of the counterweight support, viewed from the rear.
Figure 5:
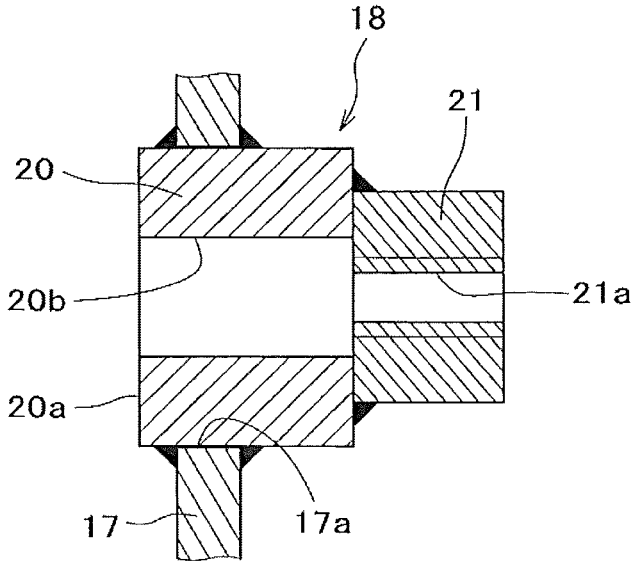
FIG. 5(A) is a cross-sectional view showing substantial parts of the counterweight support.
FIG. 5(B) is a cross-sectional view of the counterweight support to which a counterweight is attached.
Figure 5:
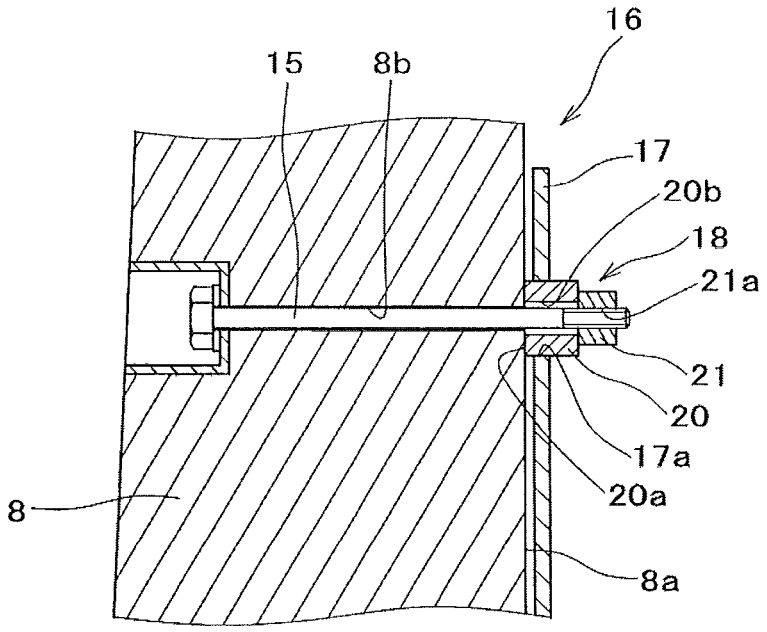
Figure 6:
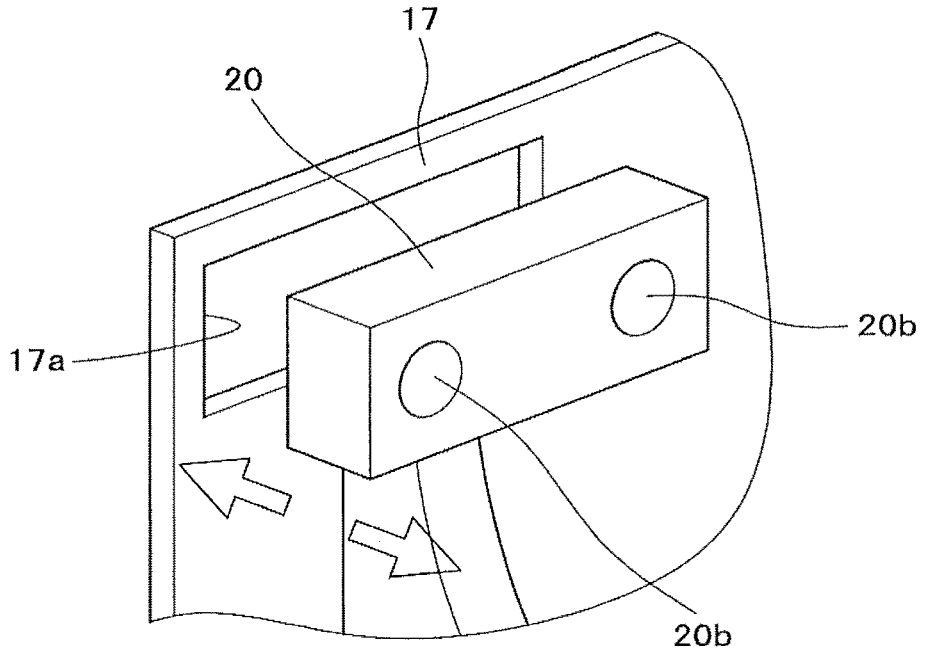
FIG. 6(A) is a perspective view showing how a base member is attached, and FIG. 6(B) a perspective view showing how a bolt fastening member is attached.
Figure 6:
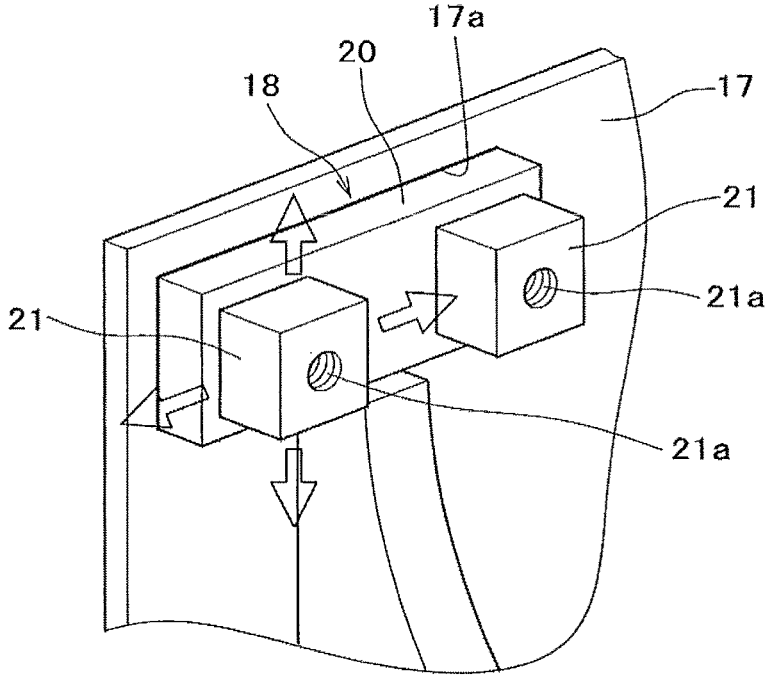

Embodiments of the present invention are now described hereinafter with reference to the drawings. In the diagrams, reference numeral 1 represents a hydraulic shovel, an example of a construction machine. The hydraulic shovel 1 is configured with parts such as a crawler-type lower traveling body 2, an upper slewing body 4 supported in a slewable manner by the lower traveling body 2 through a slewing bearing 3, and a front working unit 5 installed on the upper slewing body 4. The upper slewing body 4 is provided with an operator's cab 6 and an engine room 7, and a rear end portion of the upper slewing body 4 is provided with a counterweight 8 for balancing the load with respect to the front working unit 5.

Reference numeral 9 represents a slewing frame configuring the base of the upper slewing body 4 (corresponding to a vehicle body frame according to the present invention). The slewing frame 9 is configured with various frame materials such as a bottom surface plate 10 to which the slewing bearing 3 is attached, left and right main frames 11L, 11R taken in pairs that are provided upright on the bottom surface plate 10, have a working unit mounting seat 11*a* axially supporting a base end portion of the front working unit 5, and extend in the longitudinal direction, left and right side frames 12L, 12R provided on the outside of the left and right main frames 11L, 11R and having various pieces of equipment such as the operator's cab 6 and the engine (not shown) mounted therein, and left and right skirt channels 13L, 13R provided on the outer end portions of the left and right side frames 12L, 12R and extending in the longitudinal direction. These frame materials are welded integrally. A counterweight support 16 for supporting the counterweight 8 using fastening bolts 15 is provided at the rear portion of the slewing frame 9.

The counterweight support 16 is configured using a support plate 17, described hereinafter, which is fixed upright at the rear portion of the slewing frame 9, and support members 18, described hereinafter, which are attached to the support plate 17, brought into abutment with a front surface 8*a* of the counterweight 8, and have the fastening bolts 15 fastened thereto.

The support plate 17, one of the frame materials configuring the slewing frame 9, is integrally fixed by welding to the rear end portions of the left and right main frames 11L, 11R and of the bottom surface plate 10, with the surface of the support plate 17 being oriented vertically so as to face the front surface 8*a* of the counterweight 8 supported by the counterweight support 16. Rectangular through-holes 17*a* are opened at a total of four portions of the support plate 17, i.e., the upper left portion, the upper right portion, the lower left portion, and the lower right portion. The support members 18 are attached to these through-holes 17*a*. In the diagram, reference numeral 19 represents a reinforcing plate that is adhered to each of the corners formed between the support plate 17 and upper surfaces 11*b* of the left and right main frames 11L, 11R. Reference numeral 17*b* represents a projection that is formed on the rear surface of the support plate 17 (the surface facing the front surface 8*a* of the counterweight 8) and comes into engagement with a depression (not shown) formed in a lower portion of the front surface 8*a* of the counterweight 8.

The support members 18 are each configured using a base member 20, described hereinafter, which is attached to the support plate 17 fixed to the slewing frame 9, after the assembly of the slewing frame 9, fitted and fixed to the corresponding through-hole 17*a* of the support plate 17 in such a manner that the longitudinal position of the base member 20 is adjustable, and has a counterweight mounting seat surface 20*a*, and a bolt fastening member 21, described hereinafter, which is fixed to the base member 20 in such a manner that the vertical and lateral positions of the bolt fastening member 21 are adjustable, and has fastener holes (screw holes) 21*a* to which the fastening bolts 15 are fastened.

The base members 20 are in the shape of a rectangular block so as to be fitted to the respective rectangular through-holes 17*a* opened in the support plate 17, in such a manner that the base members can be moved in the longitudinal direction. The thickness of each base member 20 in the longitudinal direction is set to be greater than the thickness of the support plate 17 in the longitudinal direction, and the base members 20 can be moved in the longitudinal direction by the difference between the thicknesses excluding the weld leg length. The base members 20 are fitted into the through-holes 17*a* in such a manner that the rear surfaces of the base members 20 (the surfaces facing the front surface 8*a* of the counterweight 8) project farther than the rear surface of the support plate 17, wherein the rear surfaces of the base members 20 configure the counterweight mounting seat surfaces 20*a*, with which the front surface 8*a* of the counterweight 8 comes into surface-contact. Moreover, bolt holes 20*b* through which the fastening bolts 15 loosely pass are punched in the respective base members 20. The bolt holes 20*b* lead to the fastener holes 21*a* of the bolt fastening members 21 in a state where the bolt fastening members 21 are fixed to the base members 20, wherein the bolt holes 20*b* are formed to have a diameter larger than that of the fastener holes 21*a* so as to be able to allow displacement of the fastener holes 21*a* that is caused as a result of adjusting the vertical and lateral positions of the bolt fastening members 21, as will be described hereinafter. With the longitudinal positions of the base members 20 adjusted, the base members 20 fitted into the through-holes 17*a* of the support plate 17 are fixed by welding to the support plate 17 so that the counterweight mounting seat surfaces 20*a* adjusted to predetermined regular positions. In the present embodiment, left and right bolt holes 20*b* taken in pairs are punched in the base members 20 of the respective support members 18 attached to the upper left and upper right through-holes 17*a* of the support plate 17. Also, a single bolt hole 20*b* is punched in the center of each of the base members 20 of the respective support members 18 attached to the lower left and lower right through-holes 17*a*.

The bolt fastening members 21 are in the shape of a rectangular block smaller than the base member 20, in which the fastener holes 21*a* to which the fastening bolts 15 are fastened are formed in the middle. The bolt fastening members 21 are fixed in such a manner that the bolt holes 20*b* of the base members 20 and the fastener holes 21*a* lead to the front surfaces of the base members 20 (the surfaces opposite to the counterweight mounting seat surfaces 20*a*). In this case, the diameter of the bolt holes 20*b* is greater than the diameter of the fastener holes 21*a* as described above, and the position for fixing the bolt fastening members 21 to the base members 20 are set in such a manner that the entire regions of the fastener holes 21*a* can be moved vertically and laterally along the front surfaces of the base members 20, within a range leading to the bolt holes 20*b* of the base members 20. With the vertical and lateral positions of the bolt fastening members 21 being adjusted so that the vertical and lateral positions of the fastener holes 21*a* are located in the predetermined regular positions, the bolt fastening members 21 are fixed to the base members 20 by welding. Note that the bolt fastening members 21 are provided to correspond to the bolt holes 20*b* of the base members 20 individually. In the present embodiment, left and right bolt fastening members 21 taken in pairs, corresponding to left and right bolt holes 20*b* taken in pairs, are fixed to the base members 20 that are fixed to the through-holes 17*a* on the upper left portion and the upper right portion of the support plate 17, and one bolt fastening member 21 corresponding to one bolt hole 20*b* is fixed to the base members 20 that are fixed to the through-holes 17*a* on the lower left portion and the lower right portion of the support plate 17.

Then, after assembling the slewing frame 9, the counterweight support 16 is formed by fixing the base members 20 to the support plate 17 configuring the slewing frame 9 and then by fixing the bolt fastening members 21 to the base members 20. In this case, the longitudinal positions of the counterweight mounting seat surfaces 20*a* can be positioned to the regular positions by adjusting the longitudinal positions of the base members 20, and the vertical and lateral positions of the fastener holes 21*a* can be positioned to the regular positions by adjusting the vertical and lateral positions of the bolt fastening members 21. In order to fix the base members 20 and the bolt fastening members 21, the base members 20 and the bolt fastening members 21 are placed in the regular positions and held using a jig, and then fixed by welding.

On the other hand, the counterweight 8 is provided with bolt insertion holes 8*b* that have the fastening bolts 15 inserted therethrough and penetrate from the front to the rear of the counterweight 8. When supporting the counterweight 8 using the counterweight support 16, the fastening bolts 15, which are inserted into the bolt insertion holes 8*b* from the rear side of the counterweight 8, pass through the bolt holes 20*b* of the base members 20 and are threaded and fastened to the fastener holes 21*a* of the bolt fastening members 21, while having the front surface 8*a* of the counterweight 8 in surface-contact with the counterweight mounting seat surfaces 20*a* of the base members 20. In this manner, the counterweight 8 is supported by the counterweight support 16. In this case, however, the positions of the counterweight mounting seat surfaces 20*a* and the fastener holes 21*a* are adjusted to the regular positions as described above, whereby the counterweight 8 can be attached to the regular position.

In the embodiment that is configured as described above, the counterweight 8 is supported by the counterweight support 16 in the rear portion of the slewing frame 9 through the fastening bolts 15, wherein the counterweight support 16 is configured using the support plate 17 fixed upright to the rear portion of the slewing frame 9, and the support members 18 that are attached to the support plate 17 fixed to the slewing frame 9, come into abutment with the counterweight 8, and have the fastening bolts 15 fastened thereto. The support members 18 are configured using the base members 20 with the counterweight mounting seat surfaces 20*a*, which are fitted and fixed to the through-holes 17*a* opened in the support plate 17, in such a manner that the longitudinal positions of the base members 20 are adjustable, and come into abutment with the counterweight 8, and the bolt fastening members 21 that are fixed to the base members 20 in such a manner that the vertical and lateral positions of the bolt fastening members 21 are adjustable, and have the fastener holes 21*a* to which the fastening bolts 15 are fastened.

According to the present embodiment, as described above, when the support members 18 are attached to the support plate 17 fixed to the slewing frame 9, the support members 18 can be attached in view of displacement of the support plate 17 caused by welding stress or the like occurring during the assembly of the slewing frame 9. In this case, the support members 18 are configured with the base members 20 with the counterweight mounting seat surfaces 20*a*, the longitudinal positions of which are adjustable with respect to the support plate 17, and the bolt fastening members 21 with the fastener holes 21*a*, which have the vertical and lateral positions thereof adjustable with respect to the base members 20. Then, the longitudinal positions of the counterweight mounting seat surfaces 20*a* can be adjusted by adjusting the longitudinal positions of the base members 20, and the vertical and lateral positions of the fastener holes 21*a* can be adjusted by adjusting the vertical and lateral positions of the bolt fastening members 21, significantly improving the positional accuracy of the counterweight mounting seat surfaces 20*a* and of the fastener holes 21*a*. Consequently, not only is it possible to perform the work of attaching the counterweight 8 accurately, but it is also possible to reliably prevent the appearance of the configuration from being ruined by a gap or level difference that can be generated between the counterweight 8 and the cover body covering the engine room 7 or the skirt channels 13L, 13R due to displacement of the counterweight mounting seat surfaces 20*a* or fastener holes 21*a*.

In this configuration, the base members 20 have the bolt holes 20*b* that lead to the fastener holes 21*a* of the bolt fastening members 21, in a state where the bolt fastening members 21 are fixed to the base members 20. The fastening bolts 15 that are inserted from the counterweight 8 side pass through the bolt holes 20*b* of the base members 20 and are then fastened to the fastener holes 21*a* of the bolt fastening members 21. In such a case, the diameter of the bolt holes 20*b* is made large so as to be able to allow displacement of the fastener holes 21*a* caused as a result of adjusting the vertical and lateral positions of the bolt fastening members 21. Thus, even when the axial centers of the fastener holes 21*a* are shifted from the axial centers of the bolt holes 20*b* as a result of adjusting and moving the bolt fastening members 21 in the vertical and lateral directions, the fastening bolts 15 can be allowed to pass through the bolt holes 20*b* and fastened to the fastener holes 21*a* without interfering with the base members 20.

Figure 7:
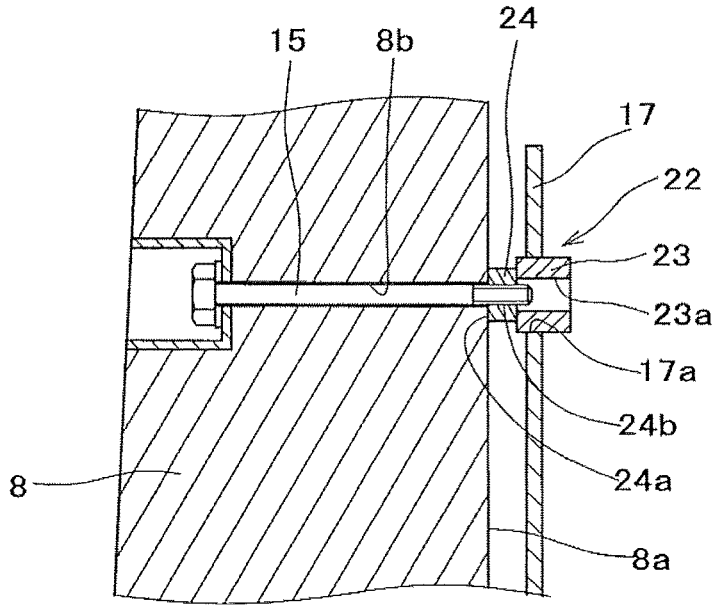
FIG. 7(A) is a cross-sectional view of the counterweight support to which is attached a counterweight according to a second embodiment.
FIG. 7(B) is a cross-sectional view of the counterweight support to which is attached a counterweight according to a third embodiment.
Figure 7:
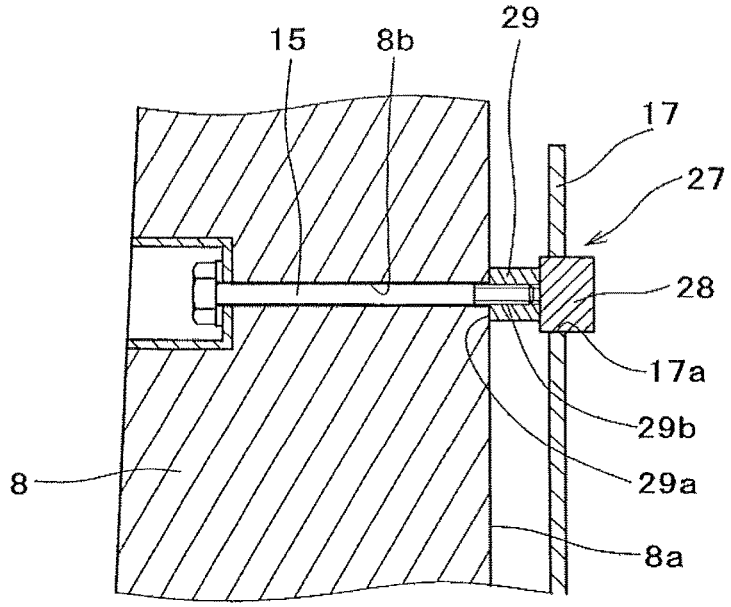

It goes without saying that the present invention is not limited to the foregoing embodiment (the first embodiment). In the support members 18 of the first embodiment, the front surfaces of the base members 20 are the counterweight mounting seat surfaces 20*a* coming into abutment with the counterweight 8, and the bolt fastening members 21 are fixed to the rear surfaces of the base members 20. In support members 22 of a second embodiment shown in FIG. 7(A), on the other hand, bolt fastening members 24 are fixed to the front surfaces of base members 23, and the front surfaces of the bolt fastening members 24 are counterweight mounting seat surfaces 24*a* coming into abutment with the counterweight 8. Even with the counterweight mounting seat surfaces 24*a* formed on the bolt fastening members 24 as described above, the longitudinal positions of the counterweight mounting seat surfaces 24*a* can be adjusted by adjusting the longitudinal positions of the base members 23. The components shown in FIG. 7(A) same as those of the first embodiment are given the same reference numerals. In FIG. 7(A), reference numeral 23*a* represents bolt holes formed in the base members 23, and 24*b* fastener holes formed in the bolt fastening members 24. The configuration of the second embodiment is the same as that of the first embodiment in that the diameter of the bolt holes 23*a* of the base members 23 is made large so as to be able to allow displacement of the fastener holes 24*b* caused as a result of adjusting the vertical and lateral positions of the bolt fastening members 24.

Support members 27 of a third embodiment shown in FIG. 7(B) are configured such that, as with the second embodiment, bolt fastening members 29 are fixed to the front surfaces of base members 28, and the front surfaces of the bolt fastening members 29 are counterweight mounting seat surfaces 29*a* coming into abutment with the counterweight 8. In the third embodiment, the longitudinal length of the bolt fastening members 29 is set long, and the tip ends of the fastening bolts 15 are configured not to project from the rear ends of fastener holes 29*b* formed in the bolt fastening members 29. This configuration does not require the bolt holes of the base members 28. The components shown in FIG. 7(B) same as those of the first embodiment are given the same reference numerals.

Figure 8:
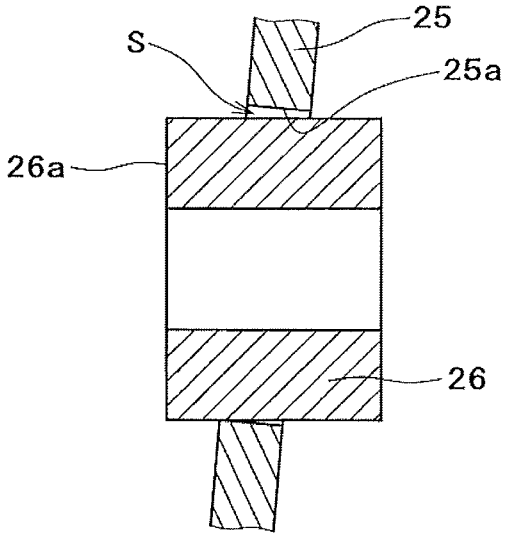
FIG. 8 is a cross-sectional view showing how a base member according to a fourth embodiment is attached.

According to a fourth embodiment shown in FIG. 8, a space S for adjusting the inclination of each base member 26 with respect to a support plate 25 is formed between the corresponding through-hole 25*a* opened in the support plate 25 and the base member 26 fitted into this through-hole 25*a*, prior to fixing the base member 26 to the through-hole 25*a*. While having the inclination of the base member 26 adjusted in such a manner that a counterweight mounting seat surface 26*a* thereof becomes parallel to the front surface 8*a* of the counterweight 8 at the regular position, the base member 26 is fixed to the support plate 25 by welding, and thereby the space S is filled as a result of this welding. By fixing the base member 26 to the support plate 25 in such a manner that the inclination of the base member 26 is adjustable with respect to the support plate 25, the inclination of the base member 26 can be adjusted in such a manner that the counterweight mounting seat surface 26*a* thereof becomes parallel to the front surface 8*a* of the counterweight 8 in the regular position, even when the support plate 25 is fixed to the slewing frame 9 while being inclined in the longitudinal, vertical, and lateral directions due to welding stress or the like. Thus, not only is it possible to ensure perpendicularity of the base member 26 with respect to the horizontal reference of the machine body (vehicle body frame), but also the flatness of mounting seat surface of the counterweight and the corresponding support member can be ensured without performing any machining. FIG. 8 shows an example in which the support plate 25 is inclined in the vertical direction, wherein the inclination and the space S are enlarged for the purpose of facilitating the understanding thereof. In addition, in FIG. 8, the base members 26 are provided with the counterweight mounting seat surfaces 26*a*, but needless to say the perpendicularity of the base members 26 with respect to the horizontal reference of the machine body can be ensured by adjusting the inclination of the base members with respect to the support plate, even if the counterweight mounting seat surfaces are provided in the bolt fastening members as in the second and third embodiments described above.

Figure 9:
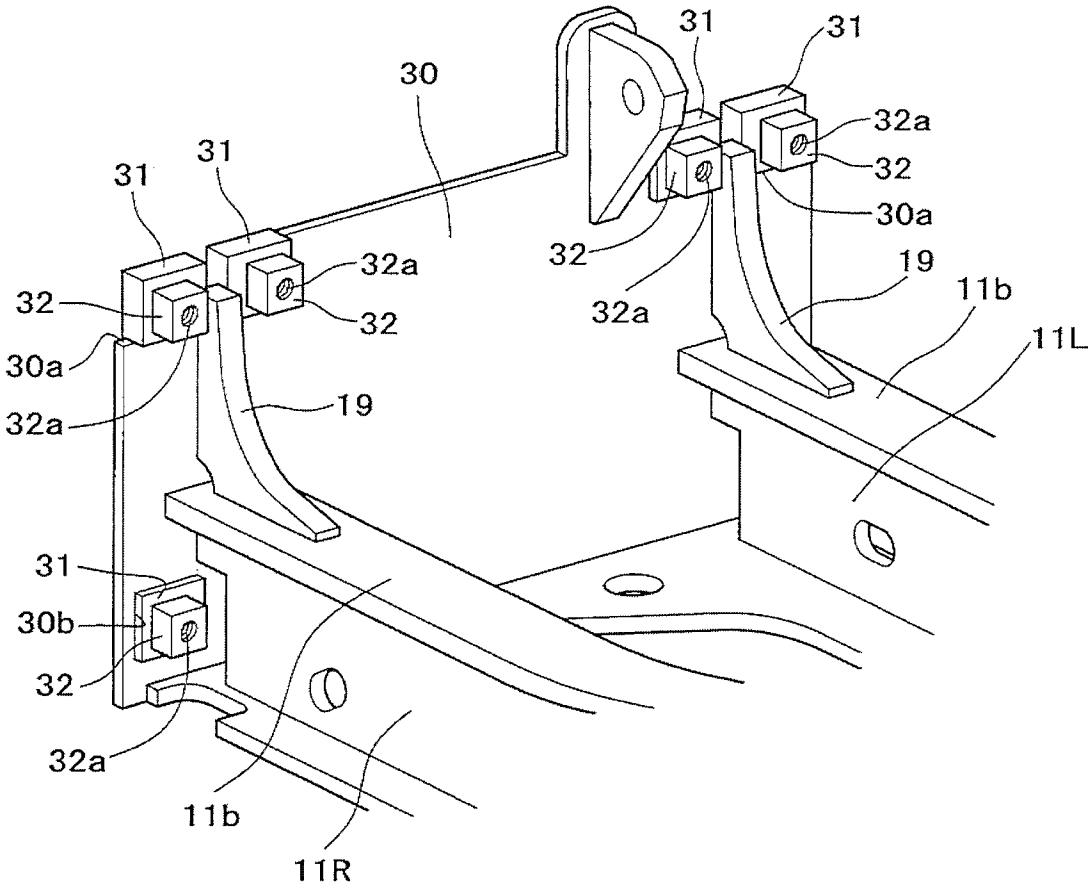
FIG. 9 is a perspective view of a counterweight support according to a fifth embodiment.

According to the configurations of the first to fourth embodiments, in order to attach the base members to the support plate in such a manner that the longitudinal positions of the base members are adjustable, the base members are fitted and fixed to the through-holes opened in the support plate, in such a manner that the longitudinal positions of the base members are adjustable. However, the first to fourth embodiments are not limited to this configuration in which the through-holes are opened in the support plate. For instance, in a fifth embodiment shown in FIG. 9, depressions 30*a* are cut out on the upper left and the upper right of a support plate 30, so that base members 31 can be fixed to the depressions 30*a* in such a manner that the longitudinal positions of the base members 31 are adjustable. Moreover, in the fifth embodiment, the base members 31 are attached to the depressions 30*a* while in abutment with the left-hand side and the right-hand side of reinforcing plates 19 that are adhered to the corners formed between the support plate 30 and the upper surfaces lib of the left and right main frames 11L and 11R, thereby reinforcing the attachment of the base members 31. In addition, through-holes 30*b* same as those of the first embodiment are formed at the lower left portion and the lower right portion of the support plate 30, and the base members 31 are attached to the through-holes 30*b* in the same manner as in the first embodiment. The components shown in FIG. 9 same as those of the first embodiment are given the same reference numerals. Also, in FIG. 9, reference numeral 32 represents bolt fastening members that are fixed to the respective base members 31 in such a manner that the longitudinal and lateral positions of the bolt fastening members are adjustable, and reference numeral 32*a* represents fastener holes formed in the respective bolt fastening members 32. Furthermore, in the fifth embodiment, counterweight mounting seat surfaces are provided in the base members 31, but needless to say the configuration of the fifth embodiment is possible in which the base members are fixed to the depressions formed on the support plates, in such a manner that the longitudinal positions of the base members are adjustable, even if the counterweight mounting seat surfaces are provided in the bolt fastening members as in the foregoing second and third embodiments. In addition, according to the fifth embodiment, as in the fourth embodiment, the perpendicularity of the base members 31 with respect to the horizontal reference of the machine body can be ensured by adjusting the inclination of the base members 31 with respect to the support plate 30.

INDUSTRIAL APPLICABILITY

The present invention can be utilized in order to attach a counterweight for ensuring the balance of the machine body in a construction machine such as a hydraulic shovel.

The invention claimed is:

1. A counterweight supporting structure for a construction machine having a counterweight and a vehicle body frame, the counterweight supporting structure comprising:

a support plate fixed upright along a vertical direction to a rear portion of the vehicle body frame, a thickness of the support plate extending from a first face of the support plate to a second face of the support plate along a longitudinal direction, the longitudinal direction being perpendicular to the vertical direction; and a support member attached to the support plate, the support member including a base member, a bolt fastening member, and a fastening bolt, a thickness of the base member extending from a first face of the base member to a second face of the base member along the longitudinal direction, the first face of the base member and the first face of the support plate each facing the counterweight of the construction machine, the thickness of the base member at least partially overlapping with the thickness of the support plate along the longitudinal direction, the first face of the base member extending beyond the first face of the support plate along the longitudinal direction, at least a portion of a periphery of the base member being welded to at least one of the first face of the support plate and the second face of the support plate, a length of the bolt fastening member extending from a first face of the bolt fastening member to a second face of the bolt fastening member along the longitudinal direction, the first face of the bolt fastening member bearing on one of the first face of the base member and the second face of the base member, the bolt fastening member being welded to the base member, an internal surface of the bolt fastening member defining a screw hole therethrough, the fastening bolt being fixed to the bolt fastening member via coupling with the screw hole.

2. The counterweight supporting structure for the construction machine according to claim 1, wherein the first face the base member is inclined relative to the first face of the support plate.

3. The counterweight supporting structure for the construction machine according to claim 1, wherein the thickness of the base member is greater than the thickness of the support plate, and the second face of the base member extends beyond the second face of the support plate along the longitudinal direction.

4. The counterweight supporting structure for the construction machine according to claim 1, wherein an internal surface of the base member defines a bolt hole therethrough, and the bolt hole is at least partially aligned with the screw hole along a transverse direction such that the fastening bolt extends through the bolt hole, the transverse direction being perpendicular to the longitudinal direction.

5. The counterweight supporting structure for the construction machine according to claim 4, wherein a dimension of the bolt hole along the transverse direction is greater than a dimension of the screw hole along the transverse direction.

6. The counterweight supporting structure for the construction machine according to claim 4, wherein the fastening bolt extends through the counterweight.

7. The counterweight supporting structure for the construction machine according to claim 1, wherein the first face of the bolt fastening member bears on the second face of the base member, and the bolt fastening member is welded to the second face of the base member.

8. The counterweight supporting structure for the construction machine according to claim 7, wherein the first face of the base member is a counterweight mounting seat surface that abuts the counterweight.

9. The counterweight supporting structure for the construction machine according to claim 1, wherein the first face of the bolt fastening member bears on the first face of the base member, and the bolt fastening member is welded to the first face of the base member.

10. The counterweight supporting structure for the construction machine according to claim 9, wherein the second face of the bolt fastening member is a counterweight mounting seat surface that abuts the counterweight.

11. The counterweight supporting structure for the construction machine according to claim 1, wherein an internal surface of the support plate defines a hole therethrough, and the base member is disposed within the hole of the support plate, such that the periphery of the base member faces the internal surface of the support plate.

12. A counterweight supporting structure for a construction machine having a counterweight and a vehicle body frame, the counterweight supporting structure being made by a process of:

fixing a support plate upright along a vertical direction to a rear portion of the vehicle body frame, a thickness of the support plate extending from a first face of the support plate to a second face of the support plate along a longitudinal direction, the longitudinal direction being perpendicular to the vertical direction;

providing a base member, a thickness of the base member extending from a first face of the base member to a second face of the base member along the longitudinal direction, the first face of the base member and the first face of the support plate each facing the counterweight of the construction machine;

adjusting a position of the base member relative to the support plate along the longitudinal direction such that the thickness of the base member at least partially overlaps with the thickness of the support plate along the longitudinal direction, and such that the first face of the base member extends beyond the first face of the support plate along the longitudinal direction;

welding at least a portion of a periphery of the base member to at least one of the first face of the support plate and the second face of the support plate;

providing a bolt fastening member, a length of the bolt fastening member extending from a first face of the bolt fastening member to a second face of the bolt fastening member along the longitudinal direction;

bearing the first face of the bolt fastening member on one of the first face of the base member and the second face of the base member;

welding the bolt fastening member to the base member; and fastening a fastening bolt to the bolt fastening member via coupling with a screw hole defined by an internal surface of the bolt fastening member.

13. The counterweight supporting structure for the construction machine according to claim 12, further comprising inclining the first face of the base member relative to the first face of the support plate.

14. The counterweight supporting structure for the construction machine according to claim 12, wherein the thickness of the base member is greater than the thickness of the support plate, and the second face of the base member extends beyond the second face of the support plate along the longitudinal direction.

15. The counterweight supporting structure for a construction machine according to claim 12, wherein an internal surface of the base member defines a bolt hole therethrough, and the bolt hole is at least partially aligned with the screw hole along a transverse direction such that the fastening bolt extends through the bolt hole, the transverse direction being perpendicular to the longitudinal direction.

16. The counterweight supporting structure for the construction machine according to claim 15, further comprising extending the fastening bolt through the counterweight before the fastening the fastening bolt to the bolt fastening member.

17. The counterweight supporting structure for the construction machine according to claim 12, further comprising bearing the first face of the bolt fastening member on the second face of the base member; and welding the bolt fastening member to the second face of the base member.

18. The counterweight supporting structure for the construction machine according to claim 17, wherein the first face of the base member is a counterweight mounting seat surface that abuts the counterweight.

19. The counterweight supporting structure for the construction machine according to claim 12, further comprising bearing the first face of the bolt fastening member on the first face of the base member; and welding the bolt fastening member to the first face of the base member.

20. The counterweight supporting structure for the construction machine according to claim 19, wherein the second face of the bolt fastening member is a counterweight mounting seat surface that abuts the counterweight.

* * * * *